United States Patent [19]

Howell

[11] 4,180,878

[45] Jan. 1, 1980

[54] WATERBED FRAME

[76] Inventor: Dione H. Howell, P.O. Box 15155, Dallas, Tex. 75201

[21] Appl. No.: 881,357

[22] Filed: Feb. 27, 1978

[51] Int. Cl.[2] ..... A47C 27/08

[52] U.S. Cl. ..... 5/431; 5/3; 5/451; 5/507; 272/144; 272/900

[58] Field of Search ..... 5/12 C, 58, 92, 319, 5/332, 368, 370, 371, 327 R; 247/417

[56] References Cited

U.S. PATENT DOCUMENTS

| | | | |
|---|---|---|---|
| 569,001 | 10/1896 | Bock | 5/12 C |
| 2,545,891 | 3/1951 | Mehr et al. | 5/53 R |
| 3,363,939 | 1/1968 | Gross | 297/417 |
| 3,872,526 | 3/1975 | Bitts | 5/370 |

*Primary Examiner*—Casmir A. Nunberg
*Attorney, Agent, or Firm*—W. Thomas Timmons

[57] ABSTRACT

A waterbed frame including a support structure for supporting a water mattress, a support ledge for supporting a user while the user is getting into or out of the waterbed, and a transition member to help the user transfer from the support ledge to the water mattress and back is disclosed. In one arrangement, the transition member is a rigid leaf member pivotally connected to the support structure at the water mattress edge of the support ledge so that when a user moves from the support ledge to the leaf member, the leaf member lowers the user onto the water mattress, spreading the user's weight over the water mattress for the entire length of the leaf member. In one arrangement, the waterbed frame can be converted into an exercise table. In an arrangement especially suited for persons confined to wheelchairs, the support ledge and the top of the water mattress are at substantially the same height as the cushion on a standard height wheelchair, making transfer from a wheelchair to the waterbed frame easier.

13 Claims, 6 Drawing Figures

WATERBED FRAME

BACKGROUND OF THE INVENTION

1. Field of the Invention

The present invention relates generally to waterbeds and waterbed frames, and in one of its aspects, to orthopedic waterbeds to provide the benefits of waterbeds to people with restricted movement.

2. Description of the Prior Art

In the past, some waterbeds have been designed to attempt to overcome the problems that even a person without impaired movement encounters when getting into and out of a waterbed. One such special water mattress is shown in U.S. Pat. No. 3,864,768 issued to Fraige et al. The water mattress shown utilizes an internal pneumatic float tube around the periphery of the water mattress to provide a buoyant edge support. The buoyant edge support was primarily intended to overcome the problem caused by a person's sitting or kneeling near the edge of the bed causing a major depression in the water mattress adjacent to the contiguous rigid frame and the resulting uncomfortable contact with the vertical support boards of the frame. One attempt to do away with the solid peripheral support frame is shown in U.S. Pat. No. 3,840,921 issued to Labianco which shows the use of a support structure for the water mattress which included an upwardly and outwardly inclined peripheral support surface engaging a lower peripheral wall section of the water mattress. The inclined peripheral support surface allowed the upper peripheral portion of the water mattress to bulge over the inclined support surface to provide a fluid support for the user at the edge of the bed.

Waterbeds provide considerable comfort for the user and are especially beneficial to persons with restricted motion since such persons are less likely than average to get an adequate amount of exercise and their restricted motion often leads to painful decubiti caused by uneven body pressure while sitting or lying down for long periods of time. A waterbed can have tremendous benefit for such a person because the waterbed spreads the body's weight out evenly, giving support to the user throughout the entire surface of the body that is in contact with the water mattress. In this way, the entire body weight is not concentrated on the painful areas which normally support the weight when resting in a conventional bed or wheelchair.

Persons with impaired movement, however, have special difficulty in taking advantage of the beneficial effects offered by a waterbed since they have special difficulty in getting into or out of a waterbed. Many people with impaired movement have very little strength in their limbs, and since the water mattress gives when a person attempts to sit up or pull himself up at the edge of the bed, they do not have adequate strength to pull themselves up into a sitting position at the edge of the water mattress. Individuals confined to a wheelchair have extreme difficulty in transferring from a wheelchair to a waterbed because of the properties of the waterbed and because of the differences in height between the waterbed and the wheelchair. A standard height wheelchair is 22 inches from the floor to the top of the seat cushion whereas waterbeds vary in height, but are normally 16 to 20 inches from the floor to the top of the water mattress.

SUMMARY OF THE INVENTION

The present invention concerns a waterbed frame that is especially helpful for people with impaired movement or limited strength. The waterbed frame of this invention is especially well suited to aid paraplegic and quadraplegic individuals and individuals confined to wheelchairs. A waterbed frame according to this invention includes a support structure for supporting a water mattress and at least one elongated, laterally extending, support ledge for supporting a user while the user is getting into or out of the waterbed. In one embodiment, the support ledge is part of the support structure. The top surface of the support ledge is substantially coplanar with the top surface of the water mattress in order to ease the transmission of the user from the support ledge to the water mattress.

A waterbed frame according to this invention also includes a transition member adjacent to the inner edge of the at least one support ledge to help in the transition of the user from the support ledge to the water mattress and back from the water mattress to the support ledge. The transition member is responsive to the weight of a user so that the transition member lowers the user onto the water mattress as the user moves from the at least one support ledge toward the water mattress and raises the user to the at least one support ledge as the user moves from the water mattress towards the at least one support ledge. In one embodiment, the transition member comprises at least one elongated, substantially rigid, leaf member pivotally connected to the support structure at the water mattress edge of the at least one support ledge, the at least one leaf member being movable between a substantially horizontal position above the water mattress and a second position which is substantially out of the way of a water mattress user. In this embodiment, the leaf member is in its substantially horizontal position above the water mattress when a user is moving from the at least one support ledge towaterbed frame also includes a means for stopping the downward swing of the leaf member so that sudden movements or heavy weights will not lower the leaf member too far into the water mattress.

One embodiment of the waterbed frame according to this invention includes a top surface of the at least one support ledge which is approximately 22 inches from the floor whereby transfer by a user from a standard height wheelchair onto the at least one support ledge is facilitated.

One embodiment of the waterbed frame according to this invention also includes at least one rigid panel, which is preferably a plurality of rigid panels for substantially covering the water mattress and a means for rigidity supporting the plurality of panels in a substantially planar configuration, thereby providing means for converting the waterbed frame into an exercise table.

A preferred form of the waterbed frame of this invention includes padding on the top surface of the support ledge and leaf member so that a user is supported on padded surfaces while getting into or out of the waterbed. It is also preferred to include a means for storing medical aids whereby a user of the waterbed can access the medical aids without leaving the waterbed. The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DETAILED DESCRIPTION

Figure 1:
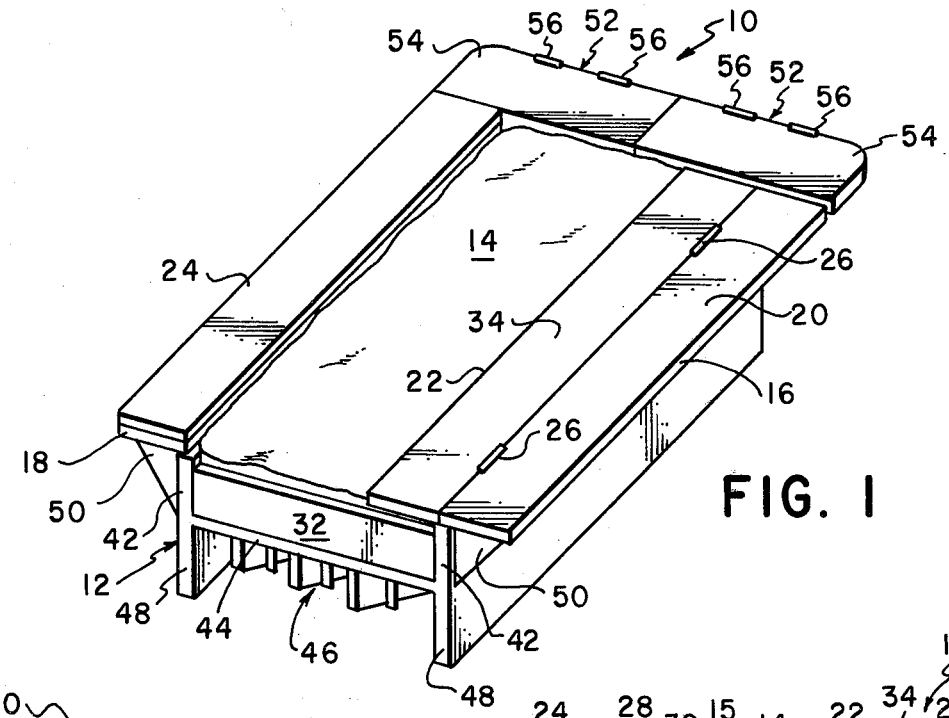
FIG. 1 is a perspective view of a waterbed frame constructed according to the teachings of the invention.
Figure 2:
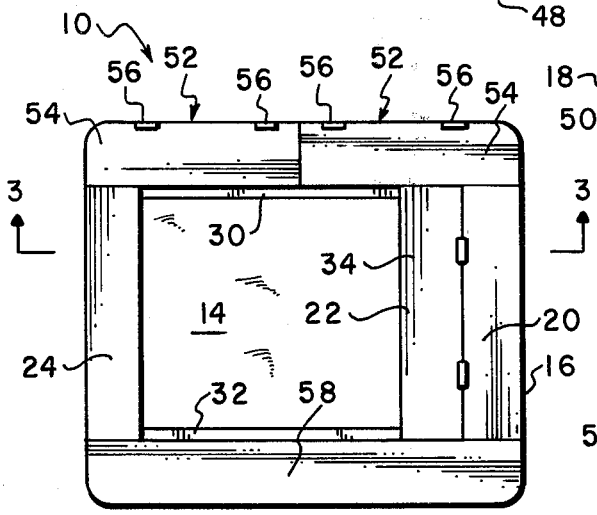
FIG. 2 is a plan view of the waterbed frame of FIG. 1.
Figure 3:
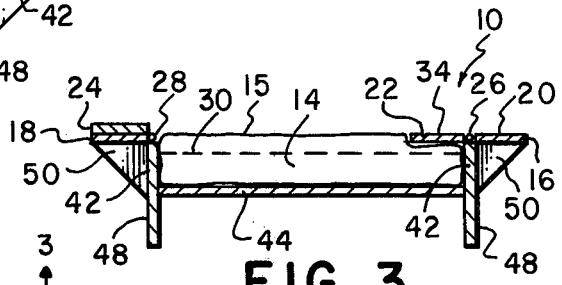
FIG. 3 is a sectional view taken along lines 3—3 of FIG. 2.

Referring now to the drawings, a waterbed frame of this invention is indicated generally by numeral 10, and includes a support structure 12 for supporting a water mattress 14 to be used with waterbed frame 10. Water mattress 14 has a top surface 15 for supporting a waterbed user. Support structure 12 includes at least one elongated, laterally extending, support ledge, in this embodiment support ledge 16 and support ledge 18, for supporting a user while the user is getting into or out of the waterbed. Support ledge 16 has a top surface 20 which is substantially coplanar with top surface 15 of water mattress 14. "Substantially coplanar" is used throughout this description to mean a relationship between two surfaces whereby the angle of transfer from one surface to another by a waterbed user is not sharp and uncomfortable.

Waterbed frame 10 also includes at least one elongated, substantially rigid, leaf member, in this case leaf member 22 and leaf member 24, pivotally connected to support structure 12 at the water mattress edge of the at least one support ledge. In this embodiment leaf member 22 is pivotally connected to support structure 12 at water mattress 14 edge of support ledge 20 by means of hinges 26, and leaf member 24 is pivotally connected to support structure 12 at water mattress 14 edge of support ledge 18 by means of hinges 28. The at least one leaf member is movable between a substantially horizontal position above water mattress 14 such as shown by leaf member 22 and a second position which is substantially out of the way of a water mattress user. Leaf member 24 is shown in a substantially horizontal position above support ledge 18, such a position being one such second position which is substantially out of the way of a water mattress user.

Waterbed frame 10 further includes a means for stopping the downward swing of leaf members 22 and 24 when at least one leaf member is in the substantially horizontal position above water mattress 14 so that the top surface of the leaf member in the water mattress position will not go significantly below top surface 15 of water mattress 14. "Significantly below" is used here to mean far enough below the surface of the portion of the water mattress not covered by leaf members 22 and 24 to make transition of a user from either leaf member to the water mattress difficult. One means for stopping the downward swing of leaf members 22 and 24 in a waterbed frame wherein the at least one leaf member comprises a leaf member extending substantially the length of water mattress 14, comprises a stop 30 at the head of waterbed frame 10 and a stop 32 at the foot of waterbed frame 10.

In one embodiment, top surface 20 of support ledge 16 is approximately twenty-two inches from the floor, twenty-two inches from the floor being the approximate height of the top of a seat cushion in a standard wheelchair, whereby transfer by a user from a standard height wheelchair onto at least one support ledge 16 is facilitated.

In one embodiment of waterbed frame 10, at least one support ledge 16 includes padding on top surface 20 and leaf member 22 includes padding on top surface 34, which is the top surface in the water mattress position, whereby a user is supported on padded surfaces while the user is getting into or out of the waterbed.

Figure 5:
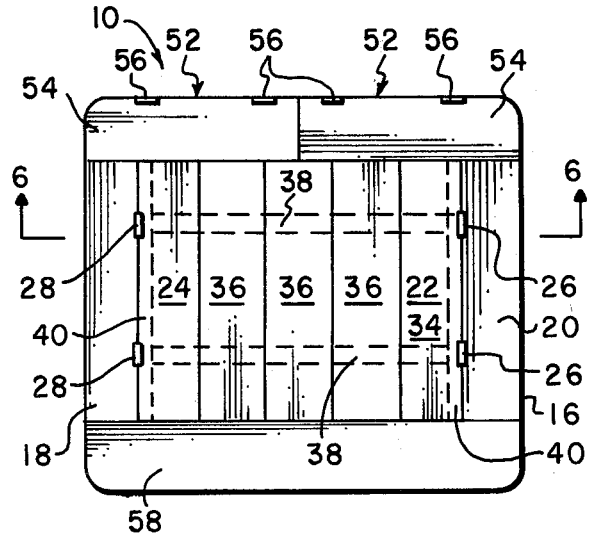
FIG. 5 is a plan view of a waterbed frame according to this invention illustrating an exercise table feature of the invention.
Figure 6:
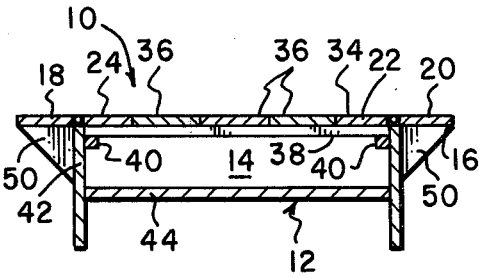
FIG. 6 is a sectional view taken along lines 6—6 of FIG. 5.

Referring now to FIGS. 5 and 6, one embodiment of waterbed frame 10 further comprises a plurality of rigid panels 36 for substantially covering water mattress 14, and a means for rigidity supporting a plurality of panels 36 in a substantially planar configuration, wherein the top surface of plurality of panels 36 is substantially coplanar with top surface 20 of at least one support ledge 16, whereby placing plurality of panels 36 into place over water mattress 14 converts waterbed frame 10 into an exercise table. One means for rigidly supporting plurality of panels 36 in a substantially planar configuration includes at least two slats 38 extending transversely beneath plurality of rigid panels 36, providing vertical support to the plurality of panels, and slat supports 40 for providing vertical support for slats 38.

Support structure 12 includes side supports 42 for providing lateral support to water mattress 14, and bottom support 44 for providing vertical support to water mattress 14. Support structure 12 further includes grid 46, shown only in FIG. 1, adjacent beneath bottom support 44, for providing additional structural support to bottom support 44. Support structure 12 further includes legs 48 for vertically supporting waterbed frame 10 at the desired height, and triangular supports 50 attached to the outside of side supports 42 for supporting support ledges 16 and 18.

Waterbed frame 10 further includes a means 52 for storing medical aids whereby a user of the waterbed can access stored medical aids without leaving the waterbed. Means 52 for storing medical aids includes a lid 54 for covering the storage means, lid 54 being pivotally mounted by hinges 56.

Waterbed frame 10 can further include an article ledge 58, not shown in FIG. 1, at the foot of waterbed frame 10 for supporting articles which the user might wish to have near him while he uses the waterbed. Article ledge 58 also serves an aesthetic function in changing the appearance of the waterbed as well as possibly being used for resting parts of the body, such as the back and shoulders in a partially upright position with the aid of pillows for reading or watching television.

It can thus be seen that when a user wants to use a waterbed utilizing waterbed frame 10 of this invention, he first pivots leaf member 22 or leaf member 24 to the water mattress 14 position. He then sits down on the corresponding support ledge, support ledge 20 for this example. He next can turn to put his feet on the support ledge or simply lean back onto leaf member 22, dragging his feet onto the support ledge. Once on the support ledge, the user slides across to leaf member 22. His weight on the leaf member lowers the leaf member into the water mattress, perhaps until it hits the stops 30 and 32. The user then slides or rolls over onto water mattress 14. Once fully on the water mattress, the user can then rotate leaf member 22 out of the way onto support ledge 20 until he is ready to lower it onto water mattress 14 again in order to get out of the waterbed. To get out of the waterbed, the user simply reverses the process for getting in.

Figure 4:
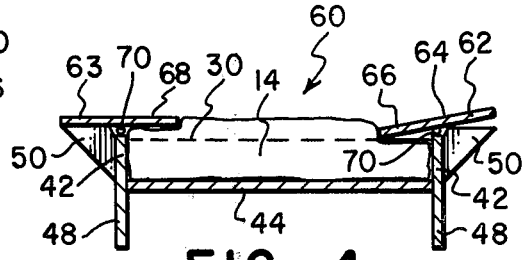
FIG. 4 is a view similar to FIG. 3 of an alternative embodiment of the invention.

Referring now to FIG. 4, another embodiment 60 of the waterbed frame includes at least one elongated, laterally extending, support ledge, in this case support ledges 62 and 63, for supporting a user while the user is getting into or out of the waterbed, support ledge 62 having a top surface 64 substantially coplanar with the top surface of water mattress 14. Waterbed frame 60 further includes a transition member 66 adjacent to water mattress 14 edge of support ledge 62 and a transition mamber 68 adjacent to water mattress 14 edge of support ledge 63, the transition members being responsive to the weight of a user so that the transition member lowers the user onto the water mattress as the user moves from support ledge 62 or 63 towards water mattress 14 and raises the user to support ledge 62 or 63 as the user moves from water mattress 14 towards the support ledge. In this embodiment, support ledge 62 is integral with transition member 66, and pivotally connected to the support structure by hinges 70, whereby the integral support ledge 62 —transition member 66 is firmly supported by triangular supports 50 when the user's weight is primarily on the support ledge 62 portion, but as the user shifts his weight so that it is primarily on the transition member 66 portion, transition member 66 transfers the user's weight to the water mattress which lowers the user to the level of the water mattress as the user shifts more of his weight to transition member 66. Transition member 66 is thereby responsive to the weight of a user. Similarly as the user moves from water mattress 14 onto transition member 66, his weight pulls transition member 66 further down against the pressure of water mattress 14, and as the user moves onto transition member 66 and progressively shifts his weight to support ledge 62, the pressure from water mattress 14 provides a force along the length of transition member 66, lifting the user to the stable position of support ledge 62.

It can thus be seen that leaf members 22 and 24 of waterbed frame 10 are generally transition members responsive to the weight of the user since leaf members 22 and 24 lower the user onto the water mattress as the user moves from the at least one support ledge towards the water mattress and raise the user to the at least one support ledge as the user moves from the water mattress towards the at least one support ledge. Similarly, one embodiment illustrated shows the support ledge as being integral with the support structure, whereas another embodiment shows the support ledge as not being integral with the support structure so that it can be seen that the description of being integral or not integral with the support structure is a matter of convenience of description and not limiting of the invention.

The waterbed frame of this invention can be made from wood, metal, or other materials that would be suitable for building conventional waterbed frames.

From the foregoing it will be seen that this invention is one well adapted to attain all the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A waterbed frame to be used with a water mattress having a top surface, the waterbed frame comprising, in combination:

a support structure for supporting the water mattress, the support structure including at least one elongated, laterally extending, support ledge for supporting a user while the user is getting into or out of the waterbed, the support ledge having a top surface substantially coplanar with the top surface of the water mattress; and at least one elongated, substantially rigid, leaf member pivotally connected to the support structure at the water mattress edge of the at least one support ledge, the at least one leaf member being movable between a first position substantially horizontal above and partially resting on the water mattress and a second position which is substantially out of the way of a water mattress user wherein the leaf member serves as a transition member when in the first position whereby the leaf member helps a user transfer from the support ledge to the water mattress and from the water mattress to the support ledge.

2. A waterbed frame according to claim 1 further including a means for stopping the downward swing of the at least one leaf member when the at least one leaf member is in the substantially horizontal position above the water mattress so that the top surface of the leaf member in the water mattress position will not go significantly below the top surface of the water mattress.

3. A waterbed frame according to claim 2 wherein the at least one leaf member comprises a leaf member extending substantially the length of the water mattress and the means for stopping the downward swing of the leaf member comprises a stop at the head of the waterbed frame and a stop at the foot of the waterbed frame.

4. A waterbed frame according to claim 3 wherein the top surface of the at least one support ledge is approximately twenty-two inches from the floor whereby transfer by a user from a standard height wheelchair onto the at least one support ledge is facilitated.

5. A waterbed frame according to claim 4 further comprising a plurality of rigid panels for substantially covering the water mattress, and a means for rigidly supporting the plurality of panels in a substantially planar configuration, wherein the top surface of the plurality of panels is substantially coplanar with the top surface of the at least one support ledge, whereby placing the plurality of panels into place over the water mattress converts the waterbed frame into an exercise table.

6. A waterbed frame according to claim 3 wherein the at least one support ledge includes padding on the top surface and the leaf member includes padding on the top surface in the water mattress position whereby a user is supported on padded surfaces while the user is getting into or out of the waterbed.

7. a waterbed frame according to claim 6 further including a means for storing medical aids whereby a user of the waterbed can access stored medical aids without leaving the waterbed.

8. A waterbed frame according to claim 1 wherein the top surface of the at least one support ledge is approximately twenty-two inches from the floor whereby transfer by a user from a standard height wheelchair onto the at least one support ledge is facilitated.

9. A waterbed frame according to claim 8 further comprising a plurality of rigid panels for substantially covering the water mattress and a means for rigidly supporting the plurality of panels in a substantially planar configuration, wherein the top surface of the plurality of panels is substantially coplanar with the top surface of the at least one support ledge, whereby placing the plurality of panels into place over the water mattress converts the waterbed frame into an exercise table.

10. A waterbed frame according to claim 1 further comprising a plurality of rigid panels for substantially covering the water mattress and a means for rigidly supporting the plurality of panels in a substantially planar configuration, wherein the top surface of the plurality of panels is substantially coplanar with the top surface of the at least one support ledge, whereby placing the plurality of panels into place over the water mattress converts the waterbed frame into an exercise table.

11. A waterbed frame to be used with a water mattress having a top surface, the waterbed frame comprising, in combination:

a support structure for supporting the water mattress;

at least one elongated, laterally extending, support ledge for supporting a user while the user is getting into or out of the waterbed, the support ledge having a top surface substantially coplanar with the top surface of the water mattress; and a transition member adjacent to the water mattress edge of the at least one support ledge, the transition member being responsive to the weight of a user so that the transition member lowers the user onto the water mattress as the user moves from the at least one support ledge towards the water mattress and raises the user to the at least one support ledge as the user moves from the water mattress towards the at least one support ledge.

12. A waterbed frame according to claim 11 wherein the top surface of the at least one support ledge is approximately twenty-two inches from the floor whereby transfer by a user from a standard height wheelchair onto the at least one support ledge is facilitated.

13. A waterbed frame according to claim 11 further comprising a plurality of rigid panels for substantially covering the water mattress, and a means for rigidly supporting the plurality of panels in a substantially planar configuration, wherein the top surface of the plurality of panels is substantially coplanar with the top surface of the at least one support ledge, whereby placing the plurality of panels into place over the water mattress converts the waterbed frame into an exercise table.

* * * * *

UNITED STATES PATENT AND TRADEMARK OFFICE

CERTIFICATE OF CORRECTION

PATENT NO. : 4,180,878

DATED : January 1, 1980

INVENTOR(S) : Dione H. Howell

It is certified that error appears in the above-identified patent and that said Letters Patent are hereby corrected as shown below:

Column 2, line 39, after "to" and before "waterbed" insert --the water mattress or back so that the leaf member is partially supported by the water mattress, spreading the weight of the user out over the entire length of the leaf member. The--.

Column 4, line 19, "rigidity" should be --rigidly--.

Column 7, line 3, "a" should be --A--.

Signed and Sealed this

*Eighteenth* Day of *March 1980*

[SEAL]

*Attest:*

SIDNEY A. DIAMOND

*Attesting Officer*

*Commissioner of Patents and Trademarks*